US008544548B2

(12) United States Patent
Coronado et al.

(10) Patent No.: US 8,544,548 B2
(45) Date of Patent: Oct. 1, 2013

(54) WATER DISSOLVABLE MATERIALS FOR ACTIVATING INFLOW CONTROL DEVICES THAT CONTROL FLOW OF SUBSURFACE FLUIDS

(75) Inventors: Martin P. Coronado, Cypress, TX (US); Steven R. Hayter, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 649 days.

(21) Appl. No.: 11/875,534

(22) Filed: Oct. 19, 2007

(65) Prior Publication Data

US 2009/0101352 A1 Apr. 23, 2009

(51) Int. Cl.
*E21B 34/00* (2006.01)

(52) U.S. Cl.
USPC ..... 166/317; 137/68.11

(58) Field of Classification Search
USPC ..... 166/317, 373, 289, 285; 137/68.11
See application file for complete search history.

(56) References Cited

U.S. PATENT DOCUMENTS

| | | | |
|---|---|---|---|
| 1,362,552 | A | 12/1920 | Alexander et al. |
| 1,649,524 | A | 11/1927 | Hammond |
| 1,915,867 | A | 6/1933 | Penick |
| 1,984,741 | A | 12/1934 | Harrington |
| 2,089,477 | A | 8/1937 | Halbert |
| 2,119,563 | A | 6/1938 | Wells |
| 2,214,064 | A | 9/1940 | Niles |
| 2,257,523 | A | 9/1941 | Combs |
| 2,412,841 | A | 12/1946 | Spangler |
| 2,762,437 | A | 9/1956 | Egan et al. |
| 2,810,352 | A | 10/1957 | Tumilson |
| 2,814,947 | A | 12/1957 | Stegemeier et al. |

(Continued)

FOREIGN PATENT DOCUMENTS

| | | |
|---|---|---|
| CN | 1385594 | 12/2002 |
| EP | 0681087 A2 | 11/1995 |

(Continued)

OTHER PUBLICATIONS

Optimization of Commingled Production Using Infinitely Variable Inflow Control Valves; M.M, J. J. Naus, Delft University of Technology (DUT), Shell International Exploration and production (SIEP); J.D. Jansen, DUT and SIEP; SPE Annual Technical Conference and Exhibition, Sep. 26-29 Houston, Texas, 2004, Society of Patent Engineers.

(Continued)

*Primary Examiner* — Giovanna Wright
*Assistant Examiner* — Kipp Wallace
(74) *Attorney, Agent, or Firm* — Mossman, Kumar & Tyler PC

(57) ABSTRACT

An apparatus for controlling flow of a fluid into a wellbore tubular may include a flow control device controlling the flow of the fluid; and a disintegrating element associated with the flow control device. The flow control device may be actuated when the disintegrating element disintegrates when exposed to the flowing fluid. The disintegrating element may disintegrate upon exposure to water in the fluid. A method for producing fluid from a subterranean formation includes: configuring an element to disintegrate when exposed to a selected fluid; positioning the element in a wellbore; and actuating a flow control device using the element. The element may disintegrate when exposed to water. Actuating the flow control device may restrict a flow of fluid into a wellbore tubular.

19 Claims, 6 Drawing Sheets

(56) References Cited

U.S. PATENT DOCUMENTS 2,942,668 A 6/1960 Maly et al.
2,945,541 A 7/1960 Maly et al.
3,326,291 A 6/1967 Zandmer
3,385,367 A 5/1968 Kollsman
3,419,089 A 12/1968 Venghiattis
3,451,477 A 6/1969 Kelley
3,675,714 A 7/1972 Thompson
3,692,064 A 9/1972 Hohnerlein et al.
3,739,845 A 6/1973 Berry et al.
3,741,301 A 6/1973 Maly et al.
3,791,444 A 2/1974 Hickey
3,876,471 A 4/1975 Jones
3,918,523 A 11/1975 Stuber
3,951,338 A 4/1976 Genna
3,975,651 A 8/1976 Griffiths
4,153,757 A 5/1979 Clark
4,173,255 A 11/1979 Kramer
4,180,132 A 12/1979 Young
4,186,100 A 1/1980 Mott
4,187,909 A 2/1980 Erbstoesser
4,248,302 A 2/1981 Churchman
4,250,907 A 2/1981 Struckman et al.
4,257,650 A 3/1981 Allen
4,287,952 A 9/1981 Erbstoesser
4,294,313 A 10/1981 Schwegman
4,415,205 A 11/1983 Rehm et al.
4,434,849 A 3/1984 Allen
4,491,186 A 1/1985 Alder
4,497,714 A 2/1985 Harris
4,552,218 A 11/1985 Ross et al.
4,572,295 A 2/1986 Walley
4,614,303 A 9/1986 Moseley, Jr. et al.
4,649,996 A 3/1987 Kojicic et al.
4,782,896 A 11/1988 Witten
4,821,800 A 4/1989 Scott et al.
4,856,590 A 8/1989 Caillier
4,917,183 A 4/1990 Gaidry et al.
4,944,349 A 7/1990 Von Gonten, Jr.
4,974,674 A 12/1990 Wells
4,998,585 A 3/1991 Newcomer et al.
5,004,049 A 4/1991 Arterbury
5,016,710 A 5/1991 Renard et al.
5,033,551 A 7/1991 Grantom
5,132,903 A 7/1992 Sinclair
5,156,811 A 10/1992 White
5,333,684 A 8/1994 Walter et al.
5,337,821 A 8/1994 Peterson
5,339,895 A 8/1994 Arterbury et al.
5,377,750 A 1/1995 Arterbury et al.
5,381,864 A 1/1995 Nguyen et al.
5,431,346 A 7/1995 Sinaisky
5,435,393 A 7/1995 Brekke et al.
5,435,395 A 7/1995 Connell
5,439,966 A 8/1995 Graham et al.
5,551,513 A 9/1996 Surles et al.
5,586,213 A 12/1996 Bridges et al.
5,597,042 A 1/1997 Tubel et al.
5,607,017 A 3/1997 Owens et al.
5,609,204 A 3/1997 Rebardi et al.
5,673,751 A 10/1997 Head et al.
5,803,179 A 9/1998 Echols
5,829,522 A 11/1998 Ross
5,831,156 A 11/1998 Mullins
5,839,508 A 11/1998 Tubel et al.
5,865,254 A 2/1999 Huber et al.
5,873,410 A 2/1999 Iato et al.
5,881,809 A 3/1999 Gillespie et al.
5,896,928 A 4/1999 Coon
5,982,801 A 11/1999 Deak
6,065,535 A 5/2000 Ross
6,068,015 A 5/2000 Pringle
6,098,020 A 8/2000 Den Boer
6,109,350 A 8/2000 Nguyen et al.
6,112,815 A 9/2000 Boe et al.
6,112,817 A * 9/2000 Voll et al. ..... 166/370
6,119,780 A 9/2000 Christmas
6,220,350 B1 4/2001 Brothers et al.
6,228,812 B1 5/2001 Dawson et al.
6,253,847 B1 7/2001 Stephenson
6,253,861 B1 7/2001 Carmichael et al.
6,273,194 B1 8/2001 Hiron
6,305,470 B1 10/2001 Woie
6,325,153 B1 12/2001 Harrell
6,338,363 B1 1/2002 Chen et al.
6,367,547 B1 4/2002 Towers et al.
6,371,210 B1 4/2002 Bode et al.
6,372,678 B1 4/2002 Youngman et al.
6,419,021 B1 7/2002 George et al.
6,474,413 B1 11/2002 Barbosa et al.
6,505,682 B2 1/2003 Brockman
6,516,888 B1 2/2003 Gunnerson et al.
6,581,681 B1 6/2003 Zimmerman et al.
6,581,682 B1 6/2003 Parent et al.
6,622,794 B2 9/2003 Zisk
6,632,527 B1 10/2003 McDaniel et al.
6,635,732 B2 10/2003 Mentak
6,667,029 B2 12/2003 Zhong et al.
6,672,385 B2 1/2004 Kilaas et al.
6,679,324 B2 1/2004 Boer et al.
6,692,766 B1 2/2004 Rubinstein et al.
6,699,503 B1 3/2004 Sako et al.
6,699,611 B2 3/2004 Kim et al.
6,786,285 B2 9/2004 Johnson et al.
6,817,416 B2 11/2004 Wilson et al.
6,840,321 B2 1/2005 Restarick et al.
6,857,476 B2 2/2005 Richards
6,863,126 B2 3/2005 McGlothen et al.
6,938,698 B2 9/2005 Coronado
6,951,252 B2 10/2005 Restarick et al.
6,976,542 B2 12/2005 Henriksen et al.
7,004,248 B2 2/2006 Hoffman et al.
7,011,076 B1 * 3/2006 Weldon et al. ..... 123/516
7,084,094 B2 8/2006 Gunn et al.
7,128,151 B2 10/2006 Corbett
7,159,656 B2 1/2007 Eoff et al.
7,185,706 B2 3/2007 Freyer
7,290,606 B2 11/2007 Coronado et al.
7,318,472 B2 1/2008 Smith
7,322,412 B2 * 1/2008 Badalamenti et al. ..... 166/285
7,325,616 B2 * 2/2008 Lopez de Cardenas et al. ..... 166/313
7,395,858 B2 7/2008 Barbosa et al.
7,409,999 B2 8/2008 Henriksen et al.
7,413,022 B2 8/2008 Broome et al.
7,419,002 B2 9/2008 Dybevik et al.
7,426,962 B2 9/2008 Moen et al.
7,469,743 B2 12/2008 Richards
7,493,947 B2 2/2009 Ross
7,673,678 B2 3/2010 MacDougall et al.
7,762,341 B2 7/2010 Hammer
7,896,028 B2 3/2011 Weyer et al.
7,896,082 B2 3/2011 Lake et al.
7,913,765 B2 3/2011 Crow et al.
7,942,206 B2 5/2011 Huang et al.
2002/0020527 A1 2/2002 Kilaas et al.
2002/0125009 A1 9/2002 Wetzel et al.
2003/0221834 A1 12/2003 Hess et al.
2004/0021107 A1 2/2004 Kimura et al.
2004/0035578 A1 2/2004 Ross et al.
2004/0052689 A1 3/2004 Yao
2004/0108107 A1 6/2004 Wittrisch
2004/0144544 A1 7/2004 Freyer
2004/0194971 A1 10/2004 Thomson
2005/0016732 A1 1/2005 Brannon et al.
2005/0126776 A1 6/2005 Russell
2005/0171248 A1 8/2005 Li et al.
2005/0178705 A1 8/2005 Broyles et al.
2005/0189119 A1 9/2005 Gynz-Rekowski
2005/0199298 A1 9/2005 Farrington
2005/0207279 A1 9/2005 Chemali et al.
2005/0241835 A1 11/2005 Burris et al.
2006/0012439 A1 1/2006 Thomsen et al.
2006/0042798 A1 3/2006 Badalamenti et al.
2006/0048936 A1 3/2006 Fripp et al.

| | | | | |
|---|---|---|---|---|
| 2006/0048942 | A1 | 3/2006 | Moen et al. | |
| 2006/0076150 | A1 | 4/2006 | Coronado et al. | |
| 2006/0086498 | A1 | 4/2006 | Wetzel et al. | |
| 2006/0108114 | A1 | 5/2006 | Johnson | |
| 2006/0118296 | A1 | 6/2006 | Dybevik et al. | |
| 2006/0175065 | A1 | 8/2006 | Ross | |
| 2006/0180320 | A1 | 8/2006 | Hilsman et al. | |
| 2006/0185849 | A1 | 8/2006 | Edwards et al. | |
| 2006/0266524 | A1 | 11/2006 | Dybevik | |
| 2006/0272814 | A1 | 12/2006 | Broome et al. | |
| 2006/0273876 | A1 | 12/2006 | Pachla et al. | |
| 2007/0012444 | A1 | 1/2007 | Horgan et al. | |
| 2007/0034385 | A1 | 2/2007 | Tips et al. | |
| 2007/0039732 | A1 | 2/2007 | Dawson et al. | |
| 2007/0039741 | A1 | 2/2007 | Hailey, Jr. | |
| 2007/0044962 | A1 | 3/2007 | Tibbles | |
| 2007/0131434 | A1 | 6/2007 | MacDougall et al. | |
| 2007/0246210 | A1 | 10/2007 | Richards | |
| 2007/0246213 | A1 | 10/2007 | Hailey, Jr. | |
| 2007/0246225 | A1 | 10/2007 | Hailey, Jr. et al. | |
| 2007/0246407 | A1 | 10/2007 | Richards et al. | |
| 2007/0272408 | A1 | 11/2007 | Zazovsky et al. | |
| 2008/0035349 | A1 | 2/2008 | Richard | |
| 2008/0035350 | A1 | 2/2008 | Henriksen et al. | |
| 2008/0053662 | A1 | 3/2008 | Williamson et al. | |
| 2008/0061510 | A1 | 3/2008 | Li et al. | |
| 2008/0110614 | A1 | 5/2008 | Orban | |
| 2008/0135249 | A1 | 6/2008 | Fripp et al. | |
| 2008/0149323 | A1 | 6/2008 | O'Malley et al. | |
| 2008/0149351 | A1 | 6/2008 | Marya et al. | |
| 2008/0236839 | A1 | 10/2008 | Oddie | |
| 2008/0236843 | A1 | 10/2008 | Scott et al. | |
| 2008/0283238 | A1 * | 11/2008 | Richards et al. | 166/228 |
| 2008/0296023 | A1 | 12/2008 | Willauer | |
| 2008/0314590 | A1 | 12/2008 | Patel | |
| 2009/0056816 | A1 | 3/2009 | Arov et al. | |
| 2009/0101355 | A1 | 4/2009 | Peterson et al. | |
| 2009/0133869 | A1 | 5/2009 | Clem | |
| 2009/0133874 | A1 | 5/2009 | Dale et al. | |
| 2009/0139727 | A1 | 6/2009 | Tanju et al. | |
| 2009/0205834 | A1 | 8/2009 | Garcia et al. | |
| 2009/0283275 | A1 | 11/2009 | Hammer | |
| 2010/0038086 | A1 | 2/2010 | Bunnell | |
| 2010/0096140 | A1 | 4/2010 | Mack | |

FOREIGN PATENT DOCUMENTS

| | | | |
|---|---|---|---|
| GB | 1492345 | | 11/1977 |
| GB | 2421527 | A1 | 6/2006 |
| GB | 2341405 | | 12/2007 |
| GB | 2448069 | A | 10/2008 |
| JP | 59089383 | | 5/1984 |
| SU | 1335677 | A | 9/1987 |
| WO | 9403743 | A1 | 2/1994 |
| WO | WO 00/79097 | | 5/2000 |
| WO | WO 01/65063 | | 2/2001 |
| WO | WO 01/77485 | | 3/2001 |
| WO | WO 02/075110 | | 9/2002 |
| WO | 2004018833 | A1 | 3/2004 |
| WO | WO 2006/015277 | | 7/2005 |
| WO | WO 2008/070674 | A1 | 6/2008 |

OTHER PUBLICATIONS

An Oil Selective Inflow Control System; Rune Freyer, Easy Well Solutions; Morten Fejerskkov, Norsk Hydro; Arve Huse, Altinex; European Petroleum Conference, Oct. 29-31, Aberdeen, United Kingdom, Copyright 2002, Society of Petroleum Engineers, Inc.

Determination of Perforation Schemes to Control Production and Injection Profiles Along Horizontal; Asheim, Harald, Norwegian Institute of Technology; Oudeman, Pier, Koninklijke/Shell Exploratie en Producktie Laboratorium; SPE Drilling & Completion, vol. 12, No. 1, March; pp. 13-18; 1997 Society of Petroleum Engineers.

Restarick, Henry, Halliburton Energy Services; Horizontal Completion Options in Reservoirs With Sand Problems, Society of Petroleum Engineers, Copyright 1995.

Dikken, Ben J.; Koninklijke/Shell E & P Laboratorium, Pressure Drop in Horizontal Wells and Its Efect on Production Performance; Nov. 1990, Copyright 1990, Society of Petroleum Engineers.

"Rapid Swelling and Deswelling of Thermoreversible Hydrophobically Modified Poly(N-Isopropylacrylamide) Hydrogels Prepared by Freezing Polymerisation", Xue, W., Hamley, I. W. and Huglin, M B., 2002, 43(1) 5181-5186.

"Thermoreversible Swelling Behavior of Hydrogels Based on N-Isopropylacrylamide with a Zwitterionic Comonomer", Xue, W., Champ, S. and Huglin, M. B. 2001, European Polymer Journal, 37(5) 869-875.

Dinarvand, R., D'Emanuele, A (1995) The use of thermoresponsive hydrogels for on-off release of molecules, J. Control. Rel. 36: 221-227.

Tanaka, T., Nishio, I., Sun. S T., Ueno-Nisho. S. (1982) Collapse of gels in an electric field, Science 218:467-469.

Ishihara,K., Hamada, N., Sato, S., Shinohara, I., (1984) Photoinduced serlling control of amphiphdilic azoaromatic polymer membrane. J. Polym Sci., Polym. Chem. Ed. 22: 121-126.

Ricka, J. Tanaka, T. (1984) Swelling of Ionic gels: Quantitative performance of the Donnan Thory. Macromolecules, 17: 2916-2921.

Stephen P. Mathis, Baker Oil Tools, SPE; "Sand Management: A Review of Approaches and Concerns: SPE 82240"; Presented at the SPE European Formation Damage Conference, Hague, The Netherlands May 13-14, 2003: Copyright 2003, Society of Petroleum Engineers Inc.

E. Paul Bercegeay, University of Southwestern Louisiana; Charles A. Richard, Baker Oil Tools, Inc. Member Aime, "A One-Trip Gravel Packing System, SPE 4771"; Prepared for the Society of Petroleum Engineers of AIME Symposium on Formation Damage Control, New Orleans, La., Feb. 7-8, 1974; Copyright 1974, American Institute of Mining, Metallurgical and Petroleum Engineers, Inc.

* cited by examiner

WATER DISSOLVABLE MATERIALS FOR ACTIVATING INFLOW CONTROL DEVICES THAT CONTROL FLOW OF SUBSURFACE FLUIDS

BACKGROUND OF THE INVENTION

1. Field of the Invention

The invention relates generally to systems and methods for selective control of fluid flow into a wellbore.

2. Description of the Related Art

Hydrocarbons such as oil and gas are recovered from a subterranean formation using a wellbore drilled into the formation. Such wells are typically completed by placing a casing along the wellbore length and perforating the casing adjacent each such production zone to extract the formation fluids (such as hydrocarbons) into the wellbore. These production zones are sometimes separated from each other by installing a packer between the production zones. Fluid from each production zone entering the wellbore is drawn into a tubing that runs to the surface. It is desirable to have substantially even drainage along the production zone. Uneven drainage may result in undesirable conditions such as an invasive gas cone or water cone. In the instance of an oil-producing well, for example, a gas cone may cause an inflow of gas into the wellbore that could significantly reduce oil production. In like fashion, a water cone may cause an inflow of water into the oil production flow that reduce the amount and quality of the produced oil. Accordingly, it is desired to provide even drainage across a production zone and/or the ability to selectively close off or reduce inflow within production zones experiencing an undesirable influx of water and/or gas.

The present disclosure addresses these and other needs of the prior art.

SUMMARY OF THE DISCLOSURE

In aspects, the present disclosure provides a method for producing fluid from a subterranean formation. In one embodiment, the method includes: configuring an element to disintegrate when exposed to a selected fluid; positioning the element in a wellbore; and actuating a flow control device using the element. In one arrangement, the element disintegrates when exposed to water. Actuating the flow control device may restrict a flow of fluid into a wellbore tubular. The method may also include applying an opening force to the flow control device to maintain the flow control device in an open position to permit flow into the wellbore tubular and/or applying a closing force to urge the flow control device to a closed position to restrict flow into the wellbore tubular. In embodiments, the method includes configuring the element to deactivate the opening force and/or release the closing force. In arrangements, the method may also include calibrating the element to disintegrate in water. In embodiments, the method may include resetting the flow control device from a closed position to an open position.

In aspects, the present disclosure provides an apparatus for controlling flow of a fluid into a wellbore tubular. The apparatus may include a flow control device controlling the flow of the fluid; and a disintegrating element associated with the flow control device. The flow control device may be actuated when the disintegrating element disintegrates when exposed to the flowing fluid. In one embodiment, the disintegrating element disintegrates upon exposure to water in the fluid. For example, the disintegrating element may be calibrated to disintegrate when exposed to water. In embodiments, an opening force associated with the flow control device may maintain the flow control device in an open position to permit flow into the wellbore tubular prior to actuation. Also, a closing force associated with the flow control device may urge the flow control device to a closed position to restrict flow into the wellbore tubular after actuation.

In aspects, the present disclosure provides a system for controlling a flow of a fluid in a well intersecting a formation of interest. In embodiments, the system includes a tubular configured to be disposed in the well; a flow control device positioned at a selected location along the tubular, the flow control device being configured to control flow between a bore of the tubular and the exterior of the tubular; and an actuator coupled to the flow control device. The actuator may include a disintegrating element calibrated to disintegrate in a predetermined manner when the disintegrating element when exposed to a selected fluid. In embodiments, the system may include a plurality of flow control device positioned at selected locations along the tubular and an actuator coupled to each flow control device. Each actuator may include a disintegrating element calibrated to disintegrate in a predetermined manner when the disintegrating element when exposed to a selected fluid. The flow control devices may be configured to cooperate to control a percentage of water in the fluid flowing in the tubular.

It should be understood that examples of the more important features of the disclosure have been summarized rather broadly in order that detailed description thereof that follows may be better understood, and in order that the contributions to the art may be appreciated. There are, of course, additional features of the disclosure that will be described hereinafter and which will form the subject of the claims appended hereto.

BRIEF DESCRIPTION OF THE DRAWINGS

The advantages and further aspects of the disclosure will be readily appreciated by those of ordinary skill in the art as the same becomes better understood by reference to the following detailed description when considered in conjunction with the accompanying drawings in which like reference characters designate like or similar elements throughout the several figures of the drawing and wherein.

DETAILED DESCRIPTION OF THE PREFERRED EMBODIMENTS

Figure 1:
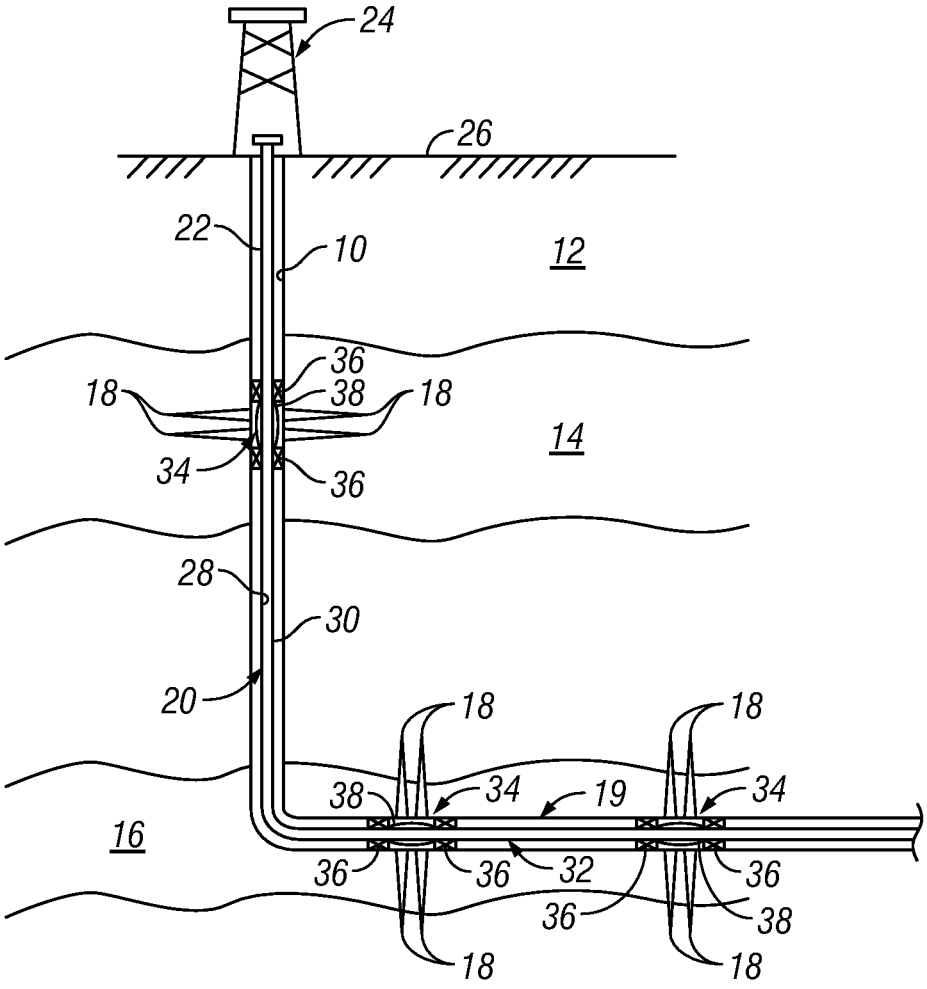
FIG. 1 is a schematic elevation view of an exemplary multi-zonal wellbore and production assembly which incorporates an inflow control system in accordance with one embodiment of the present disclosure.

The present disclosure relates to devices and methods for controlling production of a hydrocarbon producing well. The present disclosure is susceptible to embodiments of different forms. There are shown in the drawings, and herein will be described in detail, specific embodiments of the present disclosure with the understanding that the present disclosure is to be considered an exemplification of the principles of the disclosure, and is not intended to limit the disclosure to that illustrated and described herein. Further, while embodiments may be described as having one or more features or a combination of two or more features, such a feature or a combination of features should not be construed as essential unless expressly stated as essential.

Referring initially to FIG. 1, there is shown an exemplary wellbore 10 that has been drilled through the earth 12 and into a pair of formations 14, 16 from which it is desired to produce hydrocarbons. The wellbore 10 is cased by metal casing, as is known in the art, and a number of perforations 18 penetrate and extend into the formations 14, 16 so that production fluids may flow from the formations 14, 16 into the wellbore 10. The wellbore 10 has a deviated, or substantially horizontal leg 19. The wellbore 10 has a late-stage production assembly, generally indicated at 20, disposed therein by a tubing string 22 that extends downwardly from a wellhead 24 at the surface 26 of the wellbore 10. The production assembly 20 defines an internal axial flowbore 28 along its length. An annulus 30 is defined between the production assembly 20 and the wellbore casing. The production assembly 20 has a deviated, generally horizontal portion 32 that extends along the deviated leg 19 of the wellbore 10. Production devices 34 are positioned at selected points along the production assembly 20. Optionally, each production device 34 is isolated within the wellbore 10 by a pair of packer devices 36. Although only two production devices 34 are shown in FIG. 1, there may, in fact, be a large number of such production devices arranged in serial fashion along the horizontal portion 32.

Each production device 34 features a production control device 38 that is used to govern one or more aspects of a flow of one or more fluids into the production assembly 20. As used herein, the term "fluid" or "fluids" includes liquids, gases, hydrocarbons, multi-phase fluids, mixtures of two of more fluids, water, brine, engineered fluids such as drilling mud, fluids injected from the surface such as water, and naturally occurring fluids such as oil and gas. In accordance with embodiments of the present disclosure, the production control device 38 may have a number of alternative constructions that ensure selective operation and controlled fluid flow therethrough.

Figure 2:
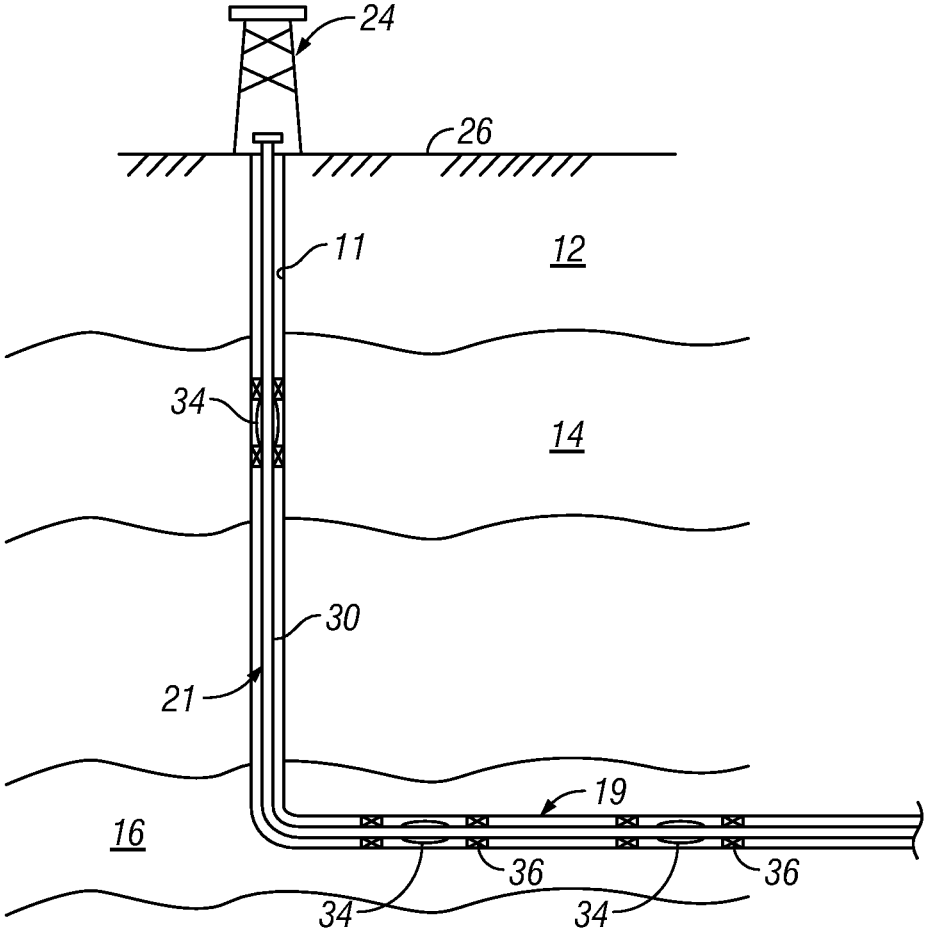
FIG. 2 is a schematic elevation view of an exemplary open hole production assembly which incorporates an inflow control system in accordance with one embodiment of the present disclosure.

FIG. 2 illustrates an exemplary open hole wellbore arrangement 11 wherein the production devices of the present disclosure may be used. Construction and operation of the open hole wellbore 11 is similar in most respects to the wellbore 10 described previously. However, the wellbore arrangement 11 has an uncased borehole that is directly open to the formations 14, 16. Production fluids, therefore, flow directly from the formations 14, 16, and into the annulus 30 that is defined between the production assembly 21 and the wall of the wellbore 11. There are no perforations, and open hole packers 36 may be used to isolate the production control devices 38. The nature of the production control device is such that the fluid flow is directed from the formation 16 directly to the nearest production device 34, hence resulting in a balanced flow. In some instances, packers maybe omitted from the open hole completion.

Figure 3:
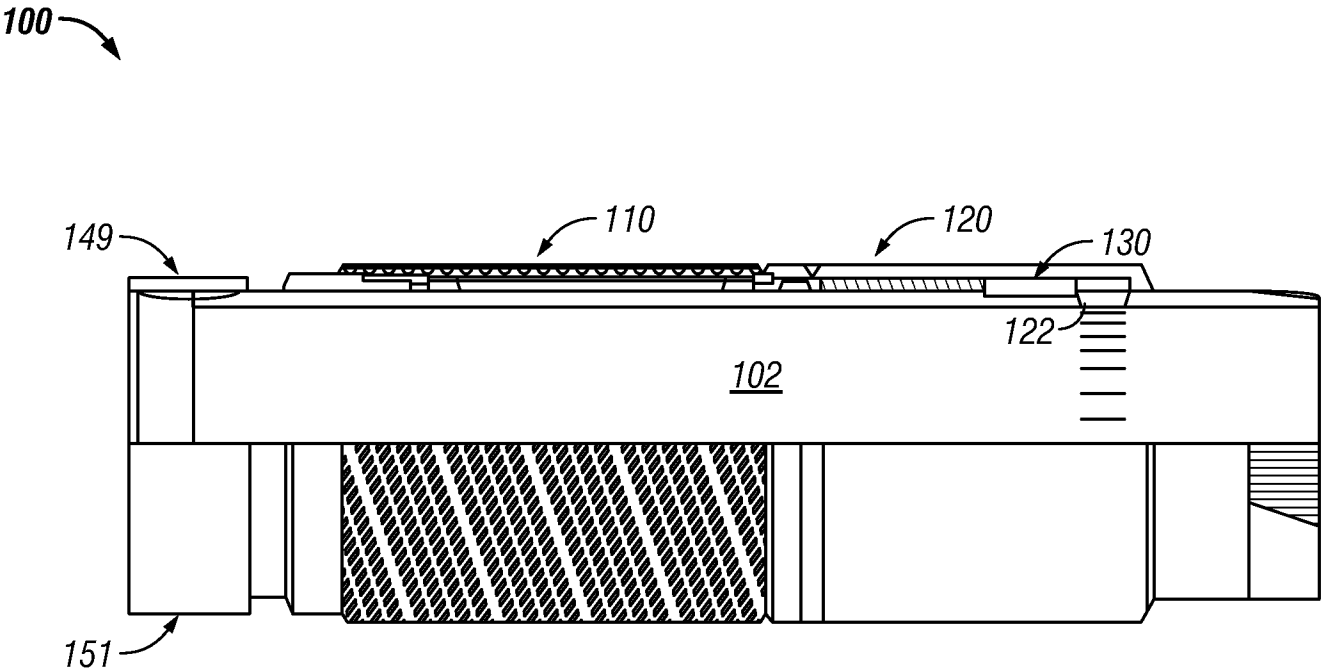
FIG. 3 is a schematic cross-sectional view of an exemplary production control device made in accordance with one embodiment of the present disclosure.

Referring now to FIG. 3, there is shown one embodiment of a production control device 100 for controlling the flow of fluids from a reservoir into a production string via one or more passages 122. This flow control can be a function of one or more characteristics or parameters of the formation fluid, including water content, fluid velocity, gas content, etc. Furthermore, the control devices 100 can be distributed along a section of a production well to provide fluid control at multiple locations. This can be advantageous, for example, to equalize production flow of oil in situations wherein a greater flow rate is expected at a "heel" of a horizontal well than at the "toe" of the horizontal well. By appropriately configuring the production control devices 100, such as by pressure equalization or by restricting inflow of gas or water, a well owner can increase the likelihood that an oil bearing reservoir will drain efficiently. Exemplary production control devices are discussed herein below.

In one embodiment, the production control device 100 includes a particulate control device 110 for reducing the amount and size of particulates entrained in the fluids, an in-flow control device 120 that controls overall drainage rate from the formation, and a flow control device 130 that controls in-flow area based upon the composition of a fluid in the vicinity of the flow control device 130. The particulate control device 110 can include known devices such as sand screens and associate gravel packs and the in-flow control device 120 can utilize devices employing tortuous fluid paths designed to control inflow rate by created pressure drops.

An exemplary flow control device 130 may be configured to control fluid flow into a flow bore 102 based upon one or more characteristics (e.g., water content) of the in-flowing fluid. In embodiments, the flow control device 130 is actuated by an element 132 that disintegrates upon exposure to one or more specified fluids in the vicinity of the flow control device 130. Exemplary types of disintegration include, but are not limited to, oxidizing, dissolving, melting, fracturing, and other such mechanisms that cause a structure to lose integrity and fail or collapse. The disintegrating element 132 may be formed of a material, such as a water soluble metal that dissolves in water, or metals such as aluminum, that oxidize or corrode, when exposed to water. The water may be a constituent component of a produced fluid; e.g., brine or salt water. In embodiments, the disintegration is calibrated. By calibrate or calibrated, it is meant that one or more characteristics relating to the capacity of the element to disintegrate is intentionally tuned or adjusted to occur in a predetermined manner or in response to a predetermined condition or set of conditions (e.g., rate, amount, etc.).

As will be appreciated, a disintegrating element may be used in numerous arrangements to shift the flow control device 130 from a substantially open position where fluid flows into the flow bore 102 to a substantially closed position where fluid flow into the flow bore 102 is restricted. In some configurations, the flow control device 130 utilizes an opening force to maintain the open position and a closing force to shift to the closed position. The disintegrating element may be used to directly or indirectly restrain the closing force or directly or indirectly keep the closing force deactivated until a specified condition has occurred. In embodiments, the condition may be a threshold value of water concentration, or water cut, in the fluid flowing across the flow control device 130. Once the disintegration sufficiently degrades the structural integrity of the disintegrating element, the closing force is applied to close or restrict flow across the flow control element 130. Illustrative applications for disintegrating elements are described below.

Figure 4:
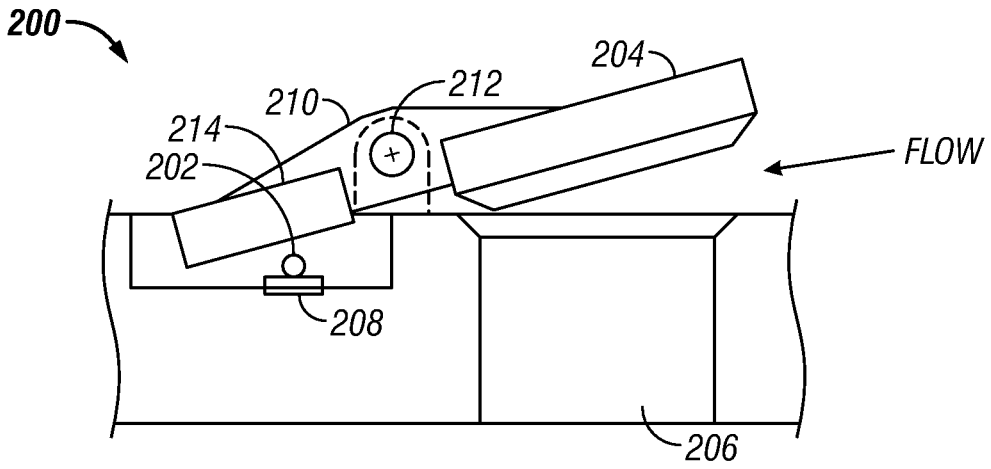
FIG. 4 is a schematic view of a flow control device made in accordance with one embodiment of the present disclosure that utilizes a disintegrating element in connection with a biasing member.

Referring now to FIG. 4, the flow control device 200 utilizes a disintegrating element 202 to selectively actuate a flow restriction element 204 that is configured to partially or completely restrict flow through an orifice 206. The orifice 206, when open, may provide fluid communication between the formation and the flow bore 102 (FIG. 3). The disintegrating element 202 is formed of a material that disintegrates in response to an increase in water cut of the in-flowing fluid. Initially, the disintegrating element 202 restrains a biasing element 208, which may be a leaf spring. In one arrangement, a lever 210 having a fulcrum at a connection point 212 connects a counter weight 214 to the flow restriction element 204. The counter weight 214 generates an opening force that counteracts the gravitational force urging the flow restriction element 204 into a sealing engagement with the orifice 206. In this case, the closing force is gravity, but in other cases, a biasing member, hydraulic pressure, pneumatic pressure, a magnetic field, etc., may urge the flow restriction element 204 toward the orifice 206.

During fluid flow with little or no water cut, the disintegrating element 202 restrains the biasing element 208 such that the flow restriction element 204 is not engaged with or seated on the orifice 206. When a sufficient amount of water surrounds the disintegrating element 202, the disintegrating element 202 dissolves or otherwise loses the capacity to restrain the biasing force applied by the biasing element 208. When released, the biasing element 208 applies a force on the lever 210 that overcomes the weight of the counter weight 214. In response, the flow restriction element 204 rotates into a sealing engagement with the orifice 206.

Figure 5:
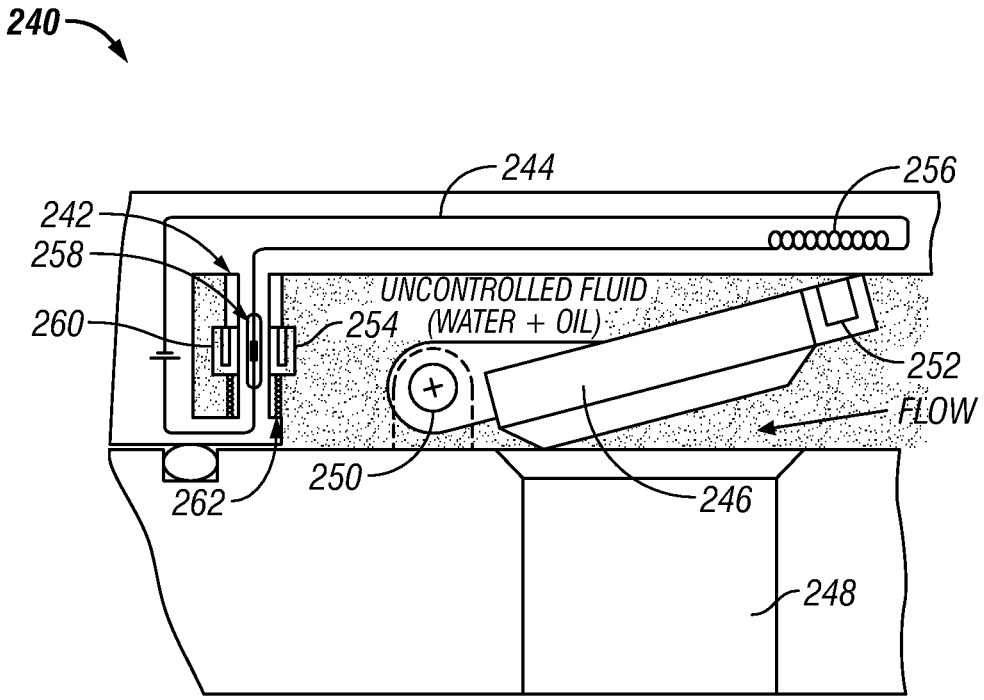
FIG. 5 is a schematic view of a flow control device made in accordance with one embodiment of the present disclosure that utilizes a disintegrating element in connection with an electrical circuit.

Referring now to FIG. 5, the flow control device 240 utilizes the disintegrating element 242 in an electrical circuit 244 that can move or displace a flow restriction element 246 that partially or completely restricts flow through an orifice 248. The orifice 248, when open, may provide fluid communication between the formation and the flow bore 102 (FIG. 3). In one arrangement, the flow restriction element 246 is coupled at a pivoting element 250 in a manner that allows rotation between an open and closed position. The flow restriction element 246 may be formed of a non-metallic material that includes a magnetic element 252 that co-acts with the electrical circuit 244. In an illustrative configuration, the electromagnetic circuit 246 generates a magnetic field that attracts the magnetic element 252. The opening force applied by the generated magnetic field pulls or rotates the flow restriction element 246 out of engagement with the orifice 248. The electrical circuit 244 may be energized using a surface power source that supplies power using a suitable conductor and/or a downhole power source. Exemplary downhole power sources include power generators and batteries.

The electrical circuit 244 includes a switch 254 that selectively energizes an electromagnetic circuit 256. In some embodiments, the switch 254 may be a switch that is activated using an applied magnetic field, such as a Reed switch. For example, the switch 254 may be moved between an energized and non-energized position by a magnetic trigger 258. The magnetic trigger 258 includes a magnetic element 260 that may slide or shift between two positions. In a first position, the magnetic field generated by the magnetic element 260 is distant from and does not affect the switch 254. In a second position, the magnetic field generated by the magnetic element 260 is proximate to and does affect the switch 254. The switch 254 may be configured to energize the electromagnetic circuit 246 when the magnetic trigger is in the first position and de-energize the electromagnetic circuit 246 when the magnetic trigger is in the second position. It should be understood that, in addition to magnetic fields, the switch 254 may also be activated by mechanical co-action, an electrical signal, a hydraulic or pneumatic arrangement, a chemical or additive, or other suitable activation systems.

Movement of the magnetic trigger 258 between the first position and the second position is controlled by the disintegrating element 242 and a biasing element 262. Initially, the disintegrating element 242 has sufficient structural integrity to maintain the biasing element 262 in a compressed state and the magnetic trigger 258 in the first position. When a sufficient amount of water surrounds the disintegrating element 242, the disintegrating element 242 loses its capacity to resist the biasing force applied by the biasing element 262. As the biasing element 262 overcomes the resistive force of the disintegrating element 242, the biasing element 262 slides the magnetic trigger 258 into the second position. When magnetic element 260 of the magnetic trigger 258 is sufficiently close to the switch 254, the switch 254 opens or breaks the electromagnetic electrical circuit 244 and thereby de-activates the magnetic field generated by the electromagnetic circuit 256. Thereafter, gravity or some other closing force urges the flow restriction element 246 to rotate into engagement with the orifice 248.

Figure 6:
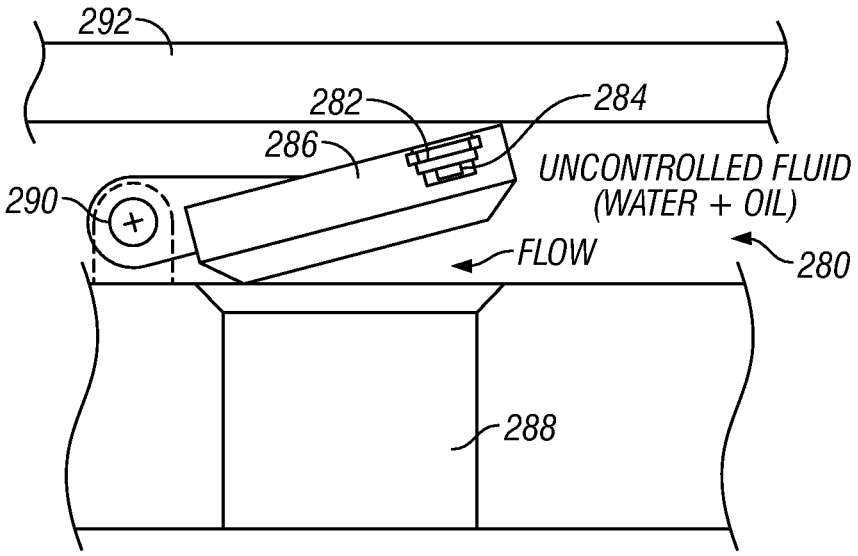
FIG. 6 is a schematic view of a flow control device made in accordance with one embodiment of the present disclosure that utilizes a disintegrating element in connection with a magnetic element.

Referring now to FIG. 6, the flow control device 280 utilizes the disintegrating element 282 to retain a magnetic element 284 within a flow restriction element 286 that partially or completely restricts flow through an orifice 288. The orifice 288, when open, may provide fluid communication between the formation and the flow bore 102 (FIG. 3). In one arrangement, the flow restriction element 286 is coupled at a pivoting element 290 in a manner that allows rotation between an open and closed position. The magnetic field of the magnetic element 284 is magnetically attracted to a magnetic component, such as a wall of a housing 292. In an illustrative configuration, the magnetic field of the magnetic element 284 maintains the flow restriction element 286 in an open position, i.e., out of engagement with the orifice 288, due to this magnetic attraction.

Movement of the flow restriction element 286 between the first position and the second position is controlled by the disintegrating element 282. Initially, the disintegrating element 282 has sufficient structural integrity to fix the magnetic element 284 within the flow restriction element 286. When a sufficient amount of water surrounds the disintegrating element 242, the disintegrating element 242 dissolves or otherwise loses its capacity to fix the magnetic element 284 to the flow restriction element 286. When the magnetic element 284 is physically separated from the flow restriction element 286, gravity or some other force urges the flow restriction element 286 to rotate into engagement with the orifice 288.

Figure 7:
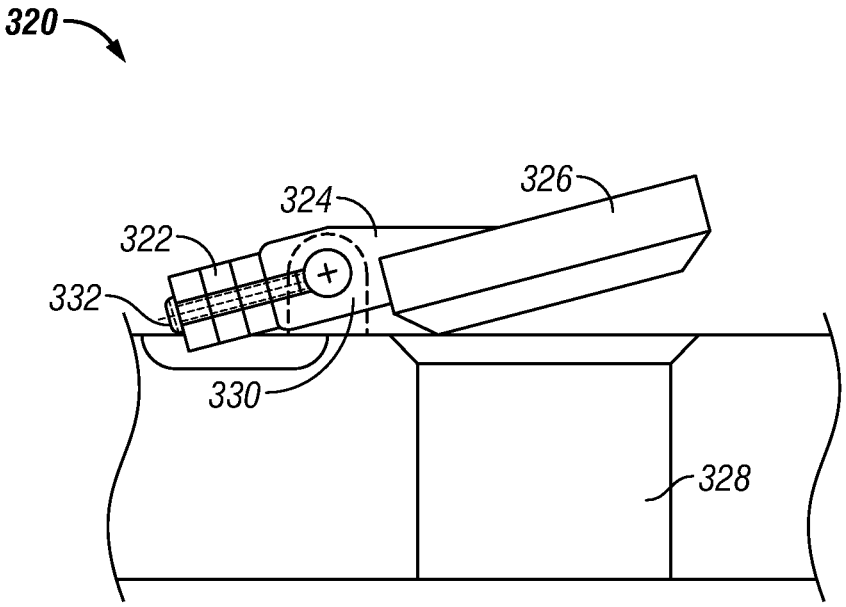
FIG. 7 is a schematic view of a flow control device made in accordance with one embodiment of the present disclosure that utilizes a disintegrating element in connection with a counter weight.

Referring now to FIG. 7, the flow control device 320 utilizes a counter weight 322 that is connected by a lever 324 to a flow restriction element 326 that partially or completely restricts flow through an orifice 328. The counter weight 322 may be formed at least partially of a disintegrating material.

The orifice 328, when open, may provide fluid communication between the formation and the flow bore 102 (FIG. 3). In one arrangement, the lever 324 includes a pivoting element 330 that allows the flow restriction element 326 to rotate between an open and closed position. The weight of the counter weight 322 exerts a downward force on the lever 324 that rotates the flow restriction element 246 upward into an open position, i.e., out of engagement with the orifice 328.

Movement of the flow restriction element 326 between the first position and the second position is controlled by the counter weight 322. Initially, the counter weight 322 has sufficient mass to exert the necessary downward force to counteract the weight of the flow restriction element 326. When a sufficient amount of water surrounds the counter weight 322, the disintegrating material of the counter weight 322 dissolves or otherwise loses its mass. When sufficient mass is lost, gravity or some other force urges the flow restriction element 326 to rotate into engagement with the orifice 328. In one variant to this embodiment, a pin 332 may be used to connect the counter weight 322 to the lever 324. In this variant, the pin 332 is formed of a disintegrating material and the counter weight 322 may be formed of a non-disintegrating material such as steel or ceramic. In another variant, both the pin 332 and the counter weight 322 are formed of a disintegrating material.

Figure 8:
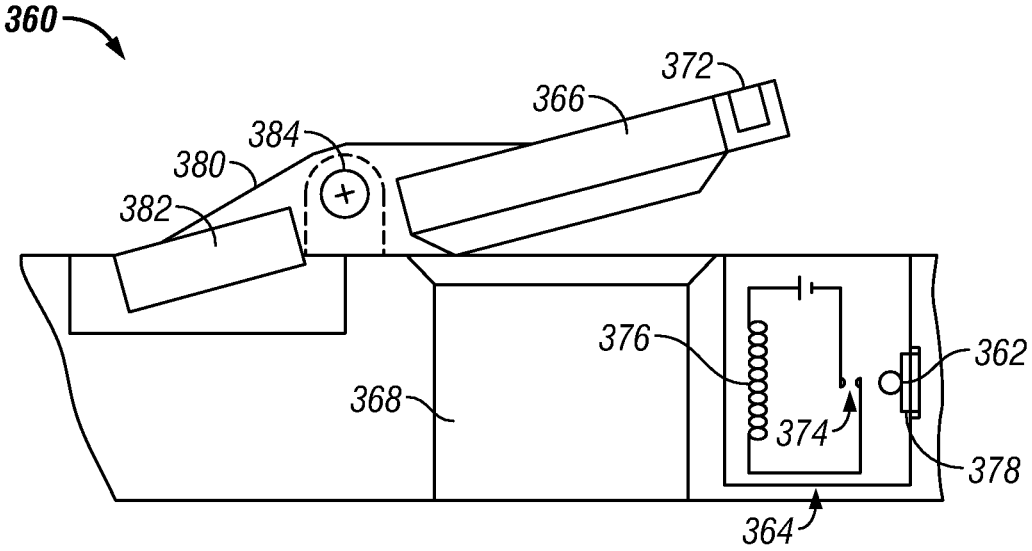
FIG. 8 is a schematic view of a flow control device made in accordance with one embodiment of the present disclosure that utilizes a disintegrating element in connection with a counter weight and an electrical circuit.

Referring now to FIG. 8, the flow control device 360 utilizes the disintegrating element 362 in an electrical circuit 364 that can move or displace a flow restriction element 366 that partially or completely restricts flow through an orifice 368. The orifice 368, when open, may provide fluid communication between the formation and the flow bore 102 (FIG. 3). In one arrangement, a lever 380 connects the flow restriction element 366 to a counter weight 382. A pivoting element 384 allows the flow restriction element 366 to rotate between an open position and a closed position. The counter weight 382 applies a downward force on the lever 380 that maintains the flow restriction element 366 in an open position. The flow restriction element 366 may be formed of a non-metallic material that includes a magnetic element 372 that co-acts with the electrical circuit 364. In an illustrative configuration, the electric circuit 364 generates a magnetic field that attracts the magnetic element 372. The closing force applied by the generated magnetic field counteracts the downward opening force of the counter weight 382 and pulls or rotates the flow restriction element 366 into engagement with the orifice 368. The electrical circuit 364 may be energized using a surface power source that supplies power using a suitable conductor and/or a downhole power source. Exemplary downhole power sources include power generators and batteries.

The electrical circuit 364 includes a switch 374 that selectively energizes an electromagnetic circuit 376. The switch 374 may be configured to de-energize the electromagnetic circuit 376 when in a first position, or "open" circuit, and energize the electromagnetic circuit 376 when in the second position, or "closed" circuit. In some embodiments, the switch 374 may be include a biasing element 378 that is configured to actuate the switch 374 to close the electrical circuit 364 to energize the electromagnetic circuit 376. The disintegrating element 362 retains the biasing element 378 to prevent the biasing element 378 from engaging the switch 374. It should be understood that, in addition to mechanical interaction, the switch 374 may also be activated by a magnetic signal, an electrical signal, a hydraulic or pneumatic arrangement, a chemical or additive, or other suitable activation systems.

Actuation of the switch 374 is controlled by the disintegrating element 362 and the biasing element 378. Initially, the disintegrating element 362 has sufficient structural integrity to maintain the biasing element 378 in a compressed state and the electrical circuit 364 in the open condition. Thus, the flow restriction element 366 is maintained in an open position by the counter weight 382. When a sufficient amount of water surrounds the disintegrating element 362, the disintegrating element 362 loses its capacity to resist the biasing force applied by the biasing element 378. As the biasing element 378 overcomes the resistive force of the disintegrating element 362, the biasing element 378 slides into engagement with the switch 374. When actuated by this engagement, the switch 374 closes the electric circuit 364 and thereby activates the electromagnetic circuit 376. Thereafter, the magnetic field pulls the flow restriction element 366 downward to rotate into engagement with the orifice 368.

Figure 9:
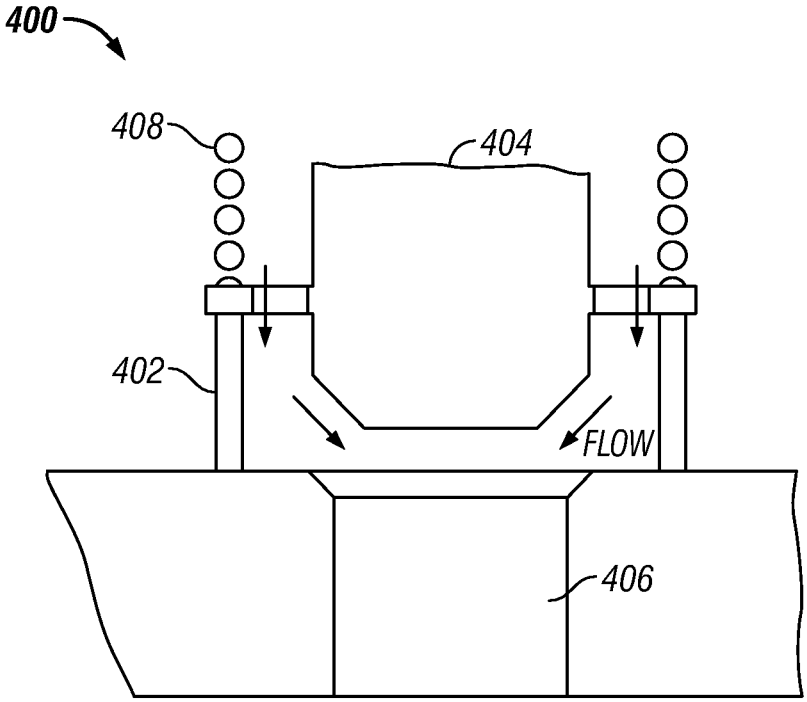
FIG. 9 is a schematic view of a flow control device made in accordance with one embodiment of the present disclosure that utilizes a disintegrating element in connection with a translating valve element.

Referring now to FIG. 9, the flow control device 400 utilizes a disintegrating element 402 that may be use to selectively actuate a flow restriction element 404 that is configured to partially or completely restrict flow through an orifice 406. The orifice 406, when open, may provide fluid communication between the formation and the flow bore 102 (FIG. 3). The disintegrating element 402 is formed of a material that disintegrates in response to an increase in water cut of the in-flowing fluid. Initially, the disintegrating element 402 restrains a biasing element 408, which may be a spring. In one arrangement, the biasing element 408 is oriented to apply a closing force that urges the flow restriction element 404 into a sealing engagement with the orifice 406. The disintegrating element 402 operates as a stop that maintains a gap between the flow restriction element 404 and the orifice 406. In this case the closing force is a biasing force, but in other cases, gravity, hydraulic pressure, etc., may urge the flow restriction element 404 toward the orifice 406.

During fluid flow with little or no water cut, the disintegrating element 402 restrains the biasing element 408 such that the flow restriction element 404 is not engaged with or seated on the orifice 406. When a sufficient amount of water surrounds the disintegrating element 402, the disintegrating element 402 dissolves or otherwise loses the capacity to restrain the biasing force applied by the biasing element 408. Thus, the biasing element 408 is released to apply a closing force that causes the flow restriction element 404 to translate into a sealing engagement with the orifice 406.

In certain embodiments, the flow control device may be configured to be reversible; i.e., return to an open position after being actuated to a closed position. For example, as discussed above, the FIG. 7 flow control device 320 utilizes a counter weight 322 that partially or completely disintegrates when exposed to water. In one variant, the counterweight 322 may be formed as replaceable modular element that is deployed by a setting tool conveyed by a suitable device, e.g., coiled tubing or drill pipe. In one mode of operation, the setting tool may be configured to move the flow control element 320 to an open position and attach a new counterweight 322 to the lever 324. Similarly, the flow control device 360 of FIG. 8 may also be configured to be reset to an open position after closing. For example, the biasing element 378 and the disintegrating element 362 retaining the biasing element 378 may be formed within a removable cartridge. After the disintegrating element 362 has dissolved, flow through the flow control device 36 may be reestablished using a setting tool that resets the switch 374, remove the spent cartridge and insert a new cartridge. It should be appreciated that these variants are merely illustrative of embodiments wherein the closing of a flow control device is reversible or resettable.

In the above-described embodiments, the flow control devices may be positioned in the wellbore such that gravity can operate as a closing force that pulls the flow restriction element downward into engagement with the orifice. In such embodiments, the flow control device may be rotatably mounted on a wellbore tubular and include a counter weight that rotates to a wellbore low side to thereby orient the flow control device at the wellbore highside.

In some embodiments, the disintegrating elements may be configured to react with an engineered fluid, such as drilling mud, or fluids introduced from the surface such as brine. Thus, in addition to a change in composition of the fluid flowing from the formation, the flow control devices can be activated as needed from the surface. Additionally, it should be understood that FIGS. 1 and 2 are intended to be merely illustrative of the production systems in which the teachings of the present disclosure may be applied. For example, in certain production systems, the wellbores 10, 11 may utilize only a casing or liner to convey production fluids to the surface. The teachings of the present disclosure may be applied to control flow to those and other wellbore tubulars.

For the sake of clarity and brevity, descriptions of most threaded connections between tubular elements, elastomeric seals, such as o-rings, and other well-understood techniques are omitted in the above description. The foregoing description is directed to particular embodiments of the present disclosure for the purpose of illustration and explanation. It will be apparent, however, to one skilled in the art that many modifications and changes to the embodiment set forth above are possible without departing from the scope of the disclosure.

What is claimed is:

1. A method for producing fluid from a subterranean formation, comprising:

configuring an element to disintegrate when exposed to a selected fluid from the formation;

positioning the element in a wellbore;

controlling a flow of fluid produced from the subterranean formation;

actuating a flow control device using the element by exposing the element to the selected fluid flowing from the formation into an annulus around a wellbore tubular:

resetting the flow control device from a closed position to an open position while the flow control device is in the wellbore.

2. The method according to claim 1 wherein the selected fluid is water that is a component of a fluid produced from the subsurface formation.

3. The method according to claim 1 further comprising applying an opening force to the flow control device overcome gravity to maintain the flow control device in an open position to permit flow into a wellbore tubular.

4. The method according to claim 3 further comprising configuring the element to deactivate the opening force to allow gravity to move the flow control device to a closed position to restrict flow into the wellbore tubular.

5. The method according to claim 1 further comprising applying a closing force to urge the flow control device to a closed position to restrict flow into the wellbore tubular.

6. The method according to claim 5 further comprising configuring the element to release the closing force.

7. The method according to claim 1 further comprising calibrating the element to disintegrate in water, wherein the water is a component of a naturally occurring fluid.

8. The method according to claim 1 wherein actuating the flow control device restricts a flow of fluid into a wellbore tubular.

9. The method according to claim 1 further comprising resetting the flow control device from a closed position to an open position.

10. An apparatus for controlling flow of a fluid into a wellbore tubular, comprising:

a flow control device configured to control fluid flowing from a formation into an annulus around the wellbore tubular, the flow control device being configured to reset from a closed position to an open position while the flow control device is in the wellbore;

a disintegrating element associated with the flow control device, the disintegrating element being configured to disintegrate when exposed to a selected fluid flowing from the formation into the annulus to actuate the flow control device.

11. The apparatus according to claim 10 wherein the disintegrating element disintegrates upon exposure to water that is a component of the fluid produced from the subsurface formation.

12. The apparatus according to claim 10 further comprising an opening force associated with the flow control device that maintains the flow control device in an open position to permit flow into the wellbore tubular prior to actuation.

13. The apparatus according to claim 10 comprising a closing force associated with the flow control device that urges the flow control device to a closed position to restrict flow into the wellbore tubular after actuation.

14. The apparatus according to claim 10 wherein the disintegrating element is calibrated to disintegrate when exposed to water, wherein the water is a component of a naturally occurring fluid.

15. A system for controlling fluid flow in a well intersecting a formation of interest, comprising:

a tubular configured to be disposed in the well;

a flow control device positioned at a selected location along the tubular, the flow control device being configured to control flow between a bore of the tubular and the exterior of the tubular, the flow control device having a first opening configured to receive a fluid from the formation of interest and a second opening configured to convey the fluid from the formation of interest into the wellbore tubular, the flow control device being further configured to reset from a closed position to an open position while the flow control device is in the wellbore; and an actuator coupled to the flow control device and configured to shift the flow control device to a closed position using gravity, the actuator including a disintegrating element calibrated to disintegrate in a predetermined manner when the disintegrating element when exposed to a fluid flowing from the formation into an annulus around the tubular.

16. The system according to claim 15 wherein the disintegrating element is configured to dissolve when exposed to water that is a component of a fluid produced from the subsurface formation.

17. The system according to claim 15 further comprising an opening force associated with the flow control device that maintains the flow control device in an open position to permit flow into the wellbore tubular prior to actuation, wherein the opening force is applied by one of (i) a spring element, and (ii) a magnet.

18. The system according to claim 15 further comprising a plurality of flow control device positioned at selected locations along the tubular, each flow control device being configured to control flow between a bore of the tubular and the exterior of the tubular; and an actuator coupled to each flow control device, each actuator including a disintegrating element calibrated to disintegrate in a predetermined manner when the disintegrating element when exposed to a selected fluid, wherein the selected fluid is a component of a naturally occurring fluid.

19. The system according to claim 18 wherein at least one of the plurality of flow control devices is configured to reduce a percentage of water in the fluid flowing in the tubular.

* * * * *